US005088544A

United States Patent [19]

Garat

[11] Patent Number: 5,088,544

[45] Date of Patent: Feb. 18, 1992

[54] PROCESS FOR THE LOST-FOAM CASTING, UNDER CONTROLLED PRESSURE, OF METAL ARTICLES

[75] Inventor: Michel Garat, Voiron, France

[73] Assignee: Aluminium Pechiney, Courbevoie, France

[21] Appl. No.: 594,706

[22] Filed: Oct. 9, 1990

Related U.S. Application Data

[63] Continuation-in-part of Ser. No. 550,499, Jul. 10, 1990, Pat. No. 5,058,653, and a continuation-in-part of Ser. No. 437,103, Nov. 16, 1989, Pat. No. 5,014,764, which is a continuation-in-part of Ser. No. 334,530, Apr. 7, 1989, abandoned, which is a continuation-in-part of Ser. No. 116,213, Nov. 3, 1987, abandoned.

[30] Foreign Application Priority Data

Oct. 31, 1989 [FR] France ..... 89 14730

[51] Int. Cl.[5] ..... B22C 9/02; B22C 9/04; B22D 27/09

[52] U.S. Cl. ..... 164/34; 164/35; 164/120

[58] Field of Search ..... 164/34, 35, 36, 120

[56] References Cited

U.S. PATENT DOCUMENTS 3,420,291 1/1969 Chandley ..... 164/120

FOREIGN PATENT DOCUMENTS 2606688 5/1988 France ..... 164/34
64-34573 2/1989 Japan ..... 164/34
1079353 3/1984 U.S.S.R. ..... 164/120

*Primary Examiner*—Richard K. Seidel
*Assistant Examiner*—Rex E. Pelto
*Attorney, Agent, or Firm*—Dennison, Meserole, Pollack & Scheiner

[57] ABSTRACT

An improvement to the process for the lost-foam casting of metal articles. According to the process, the casting takes place under a controlled pressure which initially increases at a rate between 0.003 and 0.3 MPa for a first period of at most 5 seconds from the begining of the rise in pressure. The pressure then increases during a second period at a rate higher than the rate of increase during the first period, until the maximum desired pressure is attained.

5 Claims, No Drawings

PROCESS FOR THE LOST-FOAM CASTING, UNDER CONTROLLED PRESSURE, OF METAL ARTICLES

This application is a continuation-in-part of U.S. application Ser. No. 07/550,499, filed July 10, 1990, now U.S. Pat. No. 5,058,653, and U.S. application Ser. No. 07/437,103, filed Nov. 16, 1989, now U.S. Pat. No. 5,014,764 both of which are continuations-in-part of U.S. application Ser. No. 07/334,530, filed Apr. 7, 1989, now abandoned, which is a continuation-in-part of U.S. application Ser. No. 07/116,213, filed Nov. 3, 1987, now abandoned.

The present invention relates to an improvement to the process for the lost-foam casting, under controlled pressure, of metal articles, in particular of aluminum and alloys thereof, as described in the main French patent application No. 2606688 published on May 20, 1988.

It is known to a person skilled in the art, mainly from the teaching of U.S. Pat. No. 3,157,924, that patterns of polystyrene foam which are immersed in a mould formed from dry sand containing no binder can be used for casting. In such a process, the metal to be cast, which has previously been melted, is brought into contact with the pattern by means of channels traversing the sand and is gradually substituted for said pattern by burning it and transforming it into vapour which escapes between the grains of sand.

This method has been found attractive on an industrial scale because it avoids the preliminary manufacture, by compacting and agglomeration of powdered refractory materials, of rigid moulds connected in a fairly complicated manner to cores by means of channels and allows simple recovery of the castings and easy recycling of the casting materials.

However, this method is handicapped by several drawbacks:

the relative slowness of solidification which promotes the formation of gassing pin-holes the relative weakness of the thermal gradients which can cause micro-shrinkage if the outline of the article makes feeding thereof difficult.

With the aim of overcoming such drawbacks, the applicants have developed a lost-foam casting process which forms the subject of the patent application published in France under No. 2606688.

This application teaches that, after having filled the mould with the molten metal, that is to say when the pattern has been completely destroyed by the metal, the vapour emitted by the foam has been removed and preferably before the metal begins to solidify, an isostatic gas pressure is exerted on the assembly of mould and metal. This pressure is applied in values which increase in the course of time to avoid the phenomenon of metal penetration and such that the maximum value is attained in less than 15 seconds.

In this application, the maximum pressure value was fixed between 0.5 and 1.5 MPa. However, this range was subsequently extended to 10 MPa in French Certificate of Addition No. 89-11943 filed on Sept. 7, 1989 so that, among other improvements, the fatigue resistance of the manufactured articles could be increased.

In the meantime, the applicants have also found that, in addition to the phenomenon of metal penetration leading to deformation of the article, prior liquefaction of this foam followed by gasification occurred during combustion of the foam by the metal and generated a pressure such that gas penetrated into the metal and formed blow-holes therein while causing the appearance of carbon inclusions originating from incomplete combustion of the foam residues.

To overcome this new problem, they recommended an improvement which forms the subject of the application for a Certificate of Addition filed on Mar. 7, 1989 under No. 89-03706 and which involves increasing the pressure at a rate such that, as a function of the grain size of the sand and the depth of immersion of the pattern, it rapidly and temporarily generates by loss of charge through the sand a higher pressure in the molten metal than in the sand in the region of their interface, this over-pressure attaining a value contained between two limits and subsequently decreasing as said pressure increases, then keeping said pressure constant until solidification is complete.

The rate of increase in the pressure is preferably between 0.003 and 0.3 MPa/sec, the greater the thickness of the article, the lower the rate, said maximum overpressure being reached in less than 2 seconds.

The applicants have attempted further to improve their process within the scope of the basic patent application and its improvements. In fact, it is known that the maximum pressure should be applied before the cast metal has reached a certain degree of solidification, otherwise the effect of said pressure is greatly attenuated. Now it has also been seen that, to avoid the phenomenon of metal penetration and of penetration into the article of gases issuing from the vaporisation of the foam, a given range of over-pressure initially had to be observed. This assumes that, to avoid an excessively high over-pressure, the pressure should be increased moderately during the first seconds of application. However, if this increase is kept at the same value throughout the application of pressure, it is found that all the metal has usually virtually solidified before the maximum pressure is reached and the effectiveness of the process is therefore limited.

This is why the applicants have had the idea of increasing the pressure in two stages. Hence the process characterised in that the pressure is initially increased at a rate of between 0.003 and 0.3 MPa/sec for a first period of at most 5 seconds starting from the beginning of the rise in pressure then at a rate higher than that of the first period for a second period until the maximum pressure is reached.

Thus it is possible to observe the conditions for preventing metal penetration and carbon inclusions and for reaching the maximum pressure before the metal has completely solidified. The first period is preferably at most two seconds because this value is usually sufficient to avoid the above-mentioned drawbacks. The increase in the rate of rise in pressure can be achieved in two different ways:

either one proceeds in two stages during each of which a low, constant rate is firstly applied then a high constant rate. The curve of pressure over time is therefore represented by two straight portions with a common point situated at time $t \leqq 5$ seconds. This can be achieved by placing one valve or two valves having two sections with different openings in the gas circuit.

or one proceeds with a process during which the rate increases continuously. The pressure curve is therefore represented by a continuously increasing curve in which the value of v is less than 0.3 MPa/sec at time $t \leqq 5$ seconds. This can be achieved by means of a valve of which the flow cross section progressively increases. A non-limiting example of this process involves adapting a law of opening giving a linear increase in the rate over time of the form $$\frac{dP}{dt} = kt,$$

leading to a parabolic pressure law $p = \frac{1}{2} kt^2$.

The invention can be illustrated by means of the following embodiments:

EXAMPLE 1

A header for an internal combustion engine was produced from an aluminium alloy of the A-$S_7U_3G$ type containing 6.9% by weight of silicon, 3.1% by weight of copper, 0.3% by weight of magnesium, remainder aluminium and normal impurities. This header had thick flanges and thin webs having a thickness of 3 mm for which the time for achieving a degree of solidification of 30% was about 4 seconds; furthermore, the path of the metal was long, leading to a low supply rate at the end of filling and necessitating superheating of the metal.

The metal was cast into a mould containing the polystyrene pattern immersed in sand, and a maximum pressure of 1.5 MPa was applied according to the invention, in compliance with the following procedure:

an increase of 0.25 MPa/sec so as to attain a pressure of 0.5 MPa, during the first 2 seconds.

an increase of 0.5 MPa/sec so as to attain a pressure of 1.5 MPa, during the following 2 seconds.

This procedure was carried out using two valves of different cross section placed in the gas supply circuit.

The problem of metal penetration and carbon inclusion in the article was thus avoided while obtaining conditions such that the maximum pressure is attained before the degree of solidification reaches 30%.

According to the prior art, the application of a pressure which increases over time would have led, for attaining 1.5 MPa in four seconds, to an increase of 0.375 MPa/sec, this value exceeding the limit of 0.30 MPa/sec imposed in application No. 89-03706.

EXAMPLE 2

A suspension arm was produced from an aluminium alloy of the A-$S_7$GO,3 type containing 7.5% by weight of silicon, 0.25% by weight of magnesium, remainder aluminium and its normal impurities. This arm had a normal thickness of 6 to 8 mm, and the time required to attain a degree of solidification of 30% was about 20 seconds.

The metal was cast into the mould and a maximum pressure of 8 MPa was applied according to the invention in compliance with the procedure which involves obtaining, by means of a controlled valve, a parabolic rise in pressure corresponding to the formula $P = 2 \times 10^{-2} t^2$, wherein P is expressed in MPa and t in seconds, this being achieved by means of a rate of rise in pressure $$\frac{dP}{dt} = 4 \times 10^{-2} t.$$

This procedure allowed:

during the first 2 seconds, the attainment of an increasing rate not exceeding 0.08 MPa/sec, therefore far lower than the limit of 0.30 MPa/sec imposed in application No. 89-03706 in order to avoid metal penetration but higher, from the moment $t = 0.075$ sec, than the lower limit of 0.003 MPa/sec ensuring thorough evacuation of the gaseous and liquid residues originating from the pattern.

after 20 available seconds, the attainment of the pressure of 8 MPa required for the phenomenon of compaction to be exerted fully.

The problem of metal penetration and carbon inclusion in the article has thus been avoided by adopting conditions such that the maximum pressure is reached before the degree of solidification attains 30%.

According to the prior art, the application of a pressure which increases over time would have led, for attaining 8 MPa in 20 seconds, to an increase of 0.4 MPa/sec, this value exceeding the limit required to avoid the phenomenon of metal penetration.

I claim:

1. In a process for lost foam casting of a metal part comprising the steps of:

obtaining a pattern of the part to be cast formed by a foam of organic material coated with a film of refractory material, immersing said pattern in a mold formed by dry sand without binder, filling the mold with metal in the molten state to burn said pattern, evacuating the vapors and the liquid residues emitted by the burned pattern, and causing the molten metal to solidify to produce said part, the improvement comprising applying to the mold with molten metal a substantially isostatic gas pressure, continuously increasing said gas pressure up to a maximum pressure of 0.5 to 10 MPa, and maintaining said maximum pressure, said increasing taking place at an initial rate of 0.003 to 0.3 MPa/sec for a first period of at most 5 seconds from the initiation of the increase, then during a second period at a rate higher than said initial rate up to said maximum pressure, said increase in pressure generating an overpressure in the molten metal relative to the sand having a maximum within 5 seconds from the initiation of the increase.

2. Process according to claim 1, wherein the metal is aluminum or an alloy thereof.

3. Process according to claim 1, characterised in that the first period is at most 2 seconds.

4. Process according to claim 1, characterised in that the rate is constant during each of the two periods.

5. Process according to claim 1, characterised in that the rate increases continuously during the two periods.

* * * * *